US008496458B2

(12) United States Patent
Casperson

(10) Patent No.: US 8,496,458 B2
(45) Date of Patent: Jul. 30, 2013

(54) DIE PRESS ASSEMBLY FOR POWDER PRESSING

(75) Inventor: Hans-Owe Casperson, Gustavsberg (SE)

(73) Assignee: System 3R International AB, Vaellingby (SE)

( * ) Notice: Subject to any disclaimer, the term of this patent is extended or adjusted under 35 U.S.C. 154(b) by 738 days.

(21) Appl. No.: 12/676,378

(22) PCT Filed: Sep. 3, 2008

(86) PCT No.: PCT/EP2008/061601

§ 371 (c)(1),
(2), (4) Date: Mar. 4, 2010

(87) PCT Pub. No.: WO2009/030699

PCT Pub. Date: Mar. 12, 2009

(65) Prior Publication Data

US 2010/0183757 A1 Jul. 22, 2010

(30) Foreign Application Priority Data

Sep. 6, 2007 (EP) ..... 07115779

(51) Int. Cl.
*B22F 3/03* (2006.01)

(52) U.S. Cl.
USPC ..... 425/78; 425/193; 425/352

(58) Field of Classification Search
USPC ..... 425/78, 193, 352, 414
See application file for complete search history.

(56) References Cited

U.S. PATENT DOCUMENTS

| | | | | |
|---|---|---|---|---|
| 3,848,494 | A | 11/1974 | Gargrave et al. | |
| 3,909,167 | A * | 9/1975 | Signora | 425/78 |
| 7,018,194 | B2 * | 3/2006 | Kitamura et al. | 425/193 |
| 2002/0090412 | A1 | 7/2002 | Kitamura et al. | |

FOREIGN PATENT DOCUMENTS

| | | |
|---|---|---|
| DE | 2544711 | 4/1977 |

* cited by examiner

*Primary Examiner* — James Mackey
(74) *Attorney, Agent, or Firm* — Bachman & LaPointe, P.C.

(57) ABSTRACT

A die press assembly (14) for pressing carbide steel cutting inserts for cutting tools comprising a lower clamp (8, 13) for clamping and holding a lower punch (7), a die clamp (6, 11) for clamping and holding a die (5) and a core pin clamp (10, 12) for clamping and holding a core pin (9), where the lower punch (7), the die (5) and the core pin (9) each have a bore or a recess (16, 30, 31, 32) for receiving a locking device (17).

6 Claims, 6 Drawing Sheets

DIE PRESS ASSEMBLY FOR POWDER PRESSING

BACKGROUND OF THE INVENTION

The invention relates to a die press assembly comprising a lower clamp for clamping and holding a lower punch, a die clamp for clamping and holding a die and a core pin clamp for clamping and holding a core pin, especially for powder die pressing of carbide steel inserts for metal cutting tools.

Inserts for steel cutting are made by powder die pressing from carbide steel powder. These inserts have a central hole for mounting the insert in the free end of the cutting tool. Powder pressing of such inserts requires very accurate guiding of the upper and lower pressing punches with respect to the die. On the powder pressing work station the die and the guided punches have to be exchanged for each size of the insert. In order to have as little as possible pieces of the same size of an insert on stock, the die and the punches have to be exchanged frequently. Production batch times can only be reduced by automatic changing of the die and the punch tools.

In U.S. Pat. No. 3,848,494 there is disclosed a press adapter system for standardizing the use of a die. The system comprises among other parts a punch holder and a die holder between a movable upper ram and a stationary lower press bed, where the punch holder and the die holder can be coupled together by three handles that have to be swung manually some 90° between a coupled and an uncoupled position and thereafter have to be fixed by screwing. In the coupled position the punch holder and the die holder can be transported outside from the die press while maintained in the open state.

Departing from this prior art it is an object of the invention to specify a die press assembly that can be handled and exchanged fast and easily by a robot gripper 21 or a manipulator. The handling and exchanging should be done automatically without manual intervention. The handling and exchanging of various existing types of die press assemblies should be done by one type of robot gripper 21 only.

SUMMARY OF THE INVENTION

The foregoing object is achieved by a clamp assembly comprising a lower clamp for clamping and holding a lower punch, a die clamp for clamping and holding a die and a core pin clamp for clamping and holding a core pin, where the lower punch, the die and the core pin each have a bore for receiving a locking device.

It is advantageous that the die press assembly can be handled and exchanged as one single part. This is achieved by the locking device consisting of at least one radial locking pin arranged in a radial bore in the die. This is also achieved by the locking pin having a first radial inner end portion configured for a locking arrangement within a recess in the lower punch. This is further achieved by the radial locking pin having a second radial inner end portion configured for a locking arrangement within a recess in the core pin.

BRIEF DESCRIPTION OF THE DRAWINGS

An exemplary embodiment of the invention is described with reference to the figures. In the drawings.

DETAILED DESCRIPTION

Figure 1:
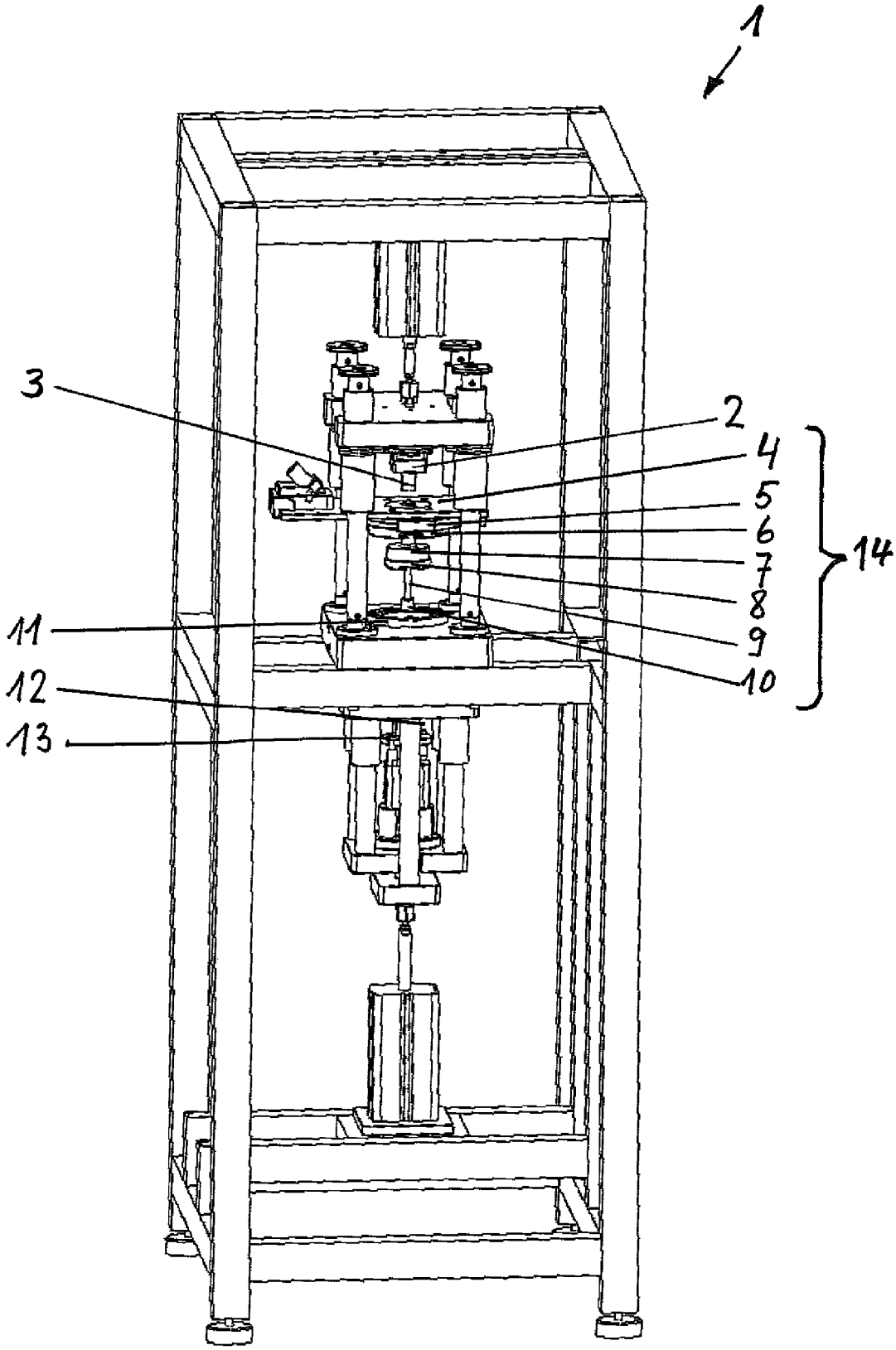
FIG. 1 shows a perspective view of a work station for pressing powder together with the die press assembly according to the invention.

In FIG. 1 a work station 1 for powder pressing is shown in an opened position. The work station 1 comprises from top to bottom: an upper chucking device 2 for clamping, holding and moving an upper punch 3, a die supporting plate 4, a die 5, a die holder 6, a lower punch 7, a lower punch holder 8, a core pin 9, a pin end connector 10, a die chuck 11 for clamping and holding the die 5 and the die holder 6, a pin chuck 12 for clamping and holding the core pin 9 and the pin end connector 10 and a lower punch chuck 13 for clamping and holding the lower punch 7 and the lower punch holder 8.

The die 5 is designed for pressing metal powder, especially carbide steel powder into the shape of a hard metal cutting insert for cutting tools. Upon exchanging from one size of metal cutting insert to another the upper chucking device 2 remains in the workstation 1. Also the chucks 11,12,13 that are used for clamping the holding devices 6,8,10 remain in the work station 1. The die 5, the lower punch 7 and the core pin 9, together with their respective holding devices 6,8,10 can be moved out of the work station 1 as one die press assembly 14.

Figure 2:
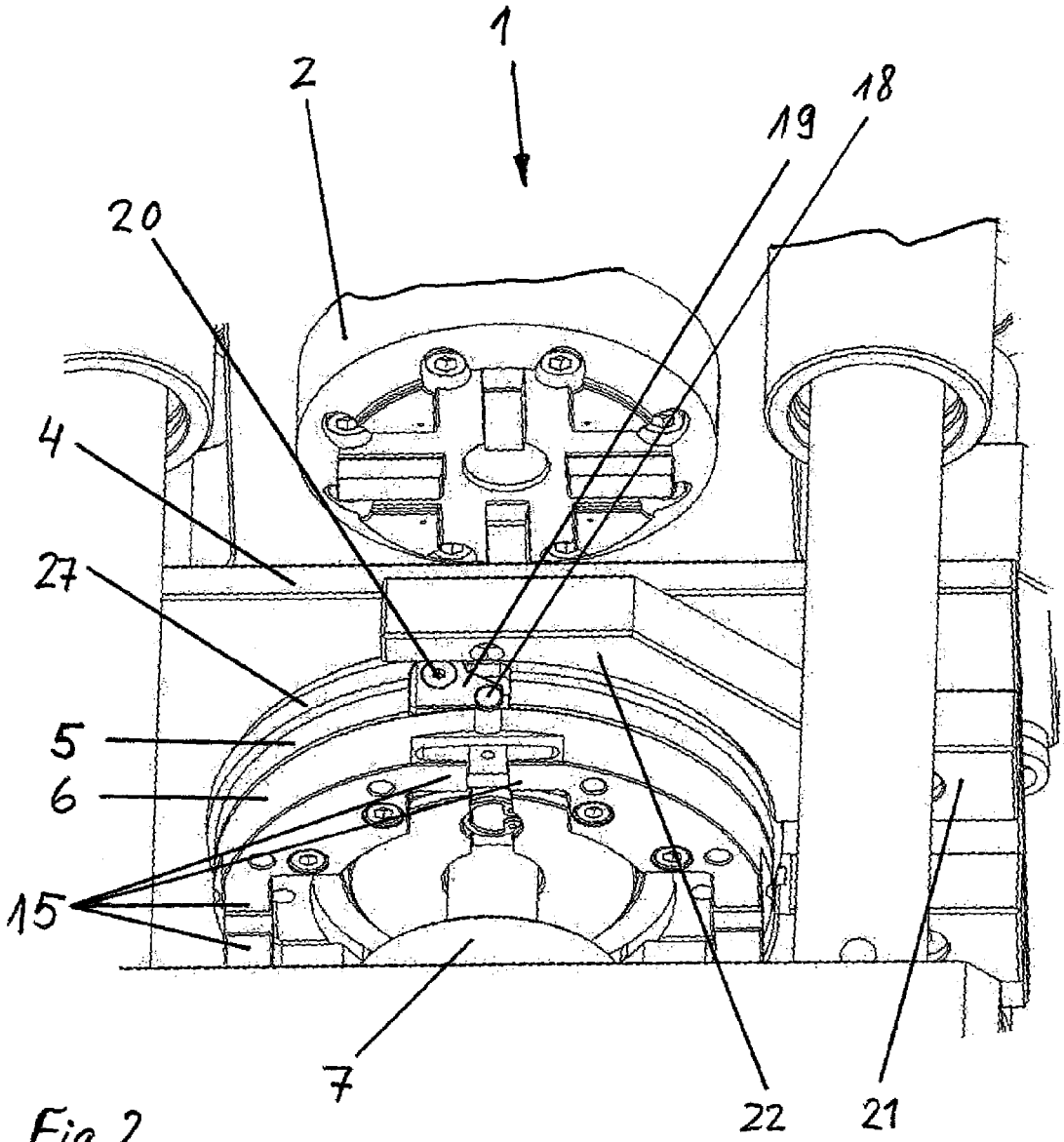
FIG. 2 shows an enlarged view on a part of the workstation of FIG. 1.

In FIG. 2 an enlarged portion of the work station 1 is shown. The die holder 6 has elastic tongues 15 for accurate clamping and positioning the die 5. In the same way the other holders can be equipped with elastic tongues 15. The die 5 has at least one radial bore 16 from the perimeter of the die 5 to the powder receiving hole in the centre of the die 5. For more accurate work the die 5 can be equipped with two bores 16 lying opposite each other along the median of the die 5. In the radial bore 16 a radial locking pin 17 can be seen. The radial outer end portion 18 of the locking pin 17 is fixed to a plate 19, which is fixed to a screw 20. The die 5 can be gripped by a gripper 21, of which one finger 22 is shown in FIG. 2.

Figure 3:
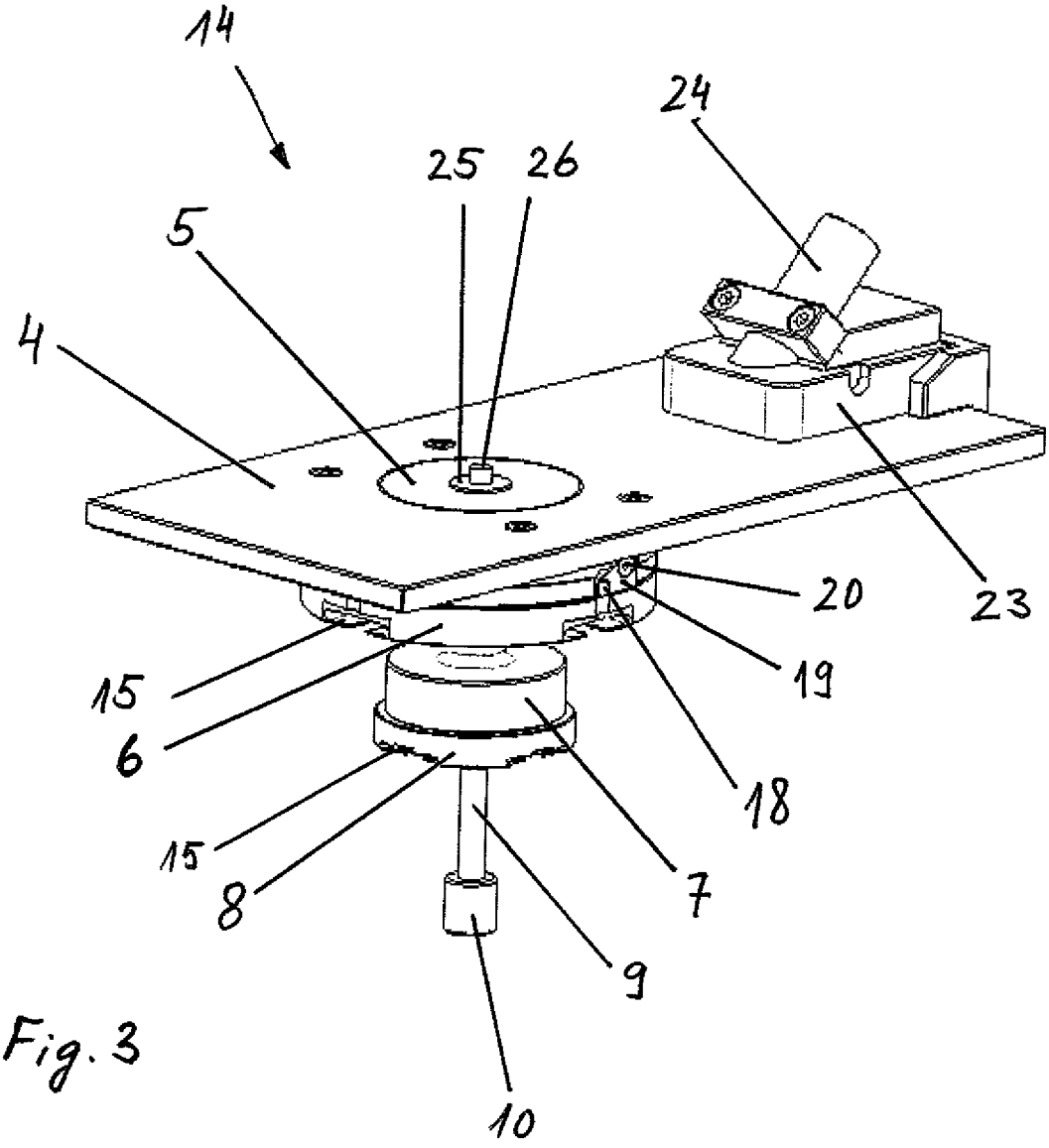
FIG. 3 shows the die press assembly together with other parts.

In FIG. 3 the die press assembly 14 is shown together with the die supporting plate 4, a sledge 23 and a tube 24 for supplying the metal powder to the die 5. These and other parts, e.g. the so-called drawbars will be exchanged together with the die press assembly 14, but are removed for better visualization.

Figure 4:
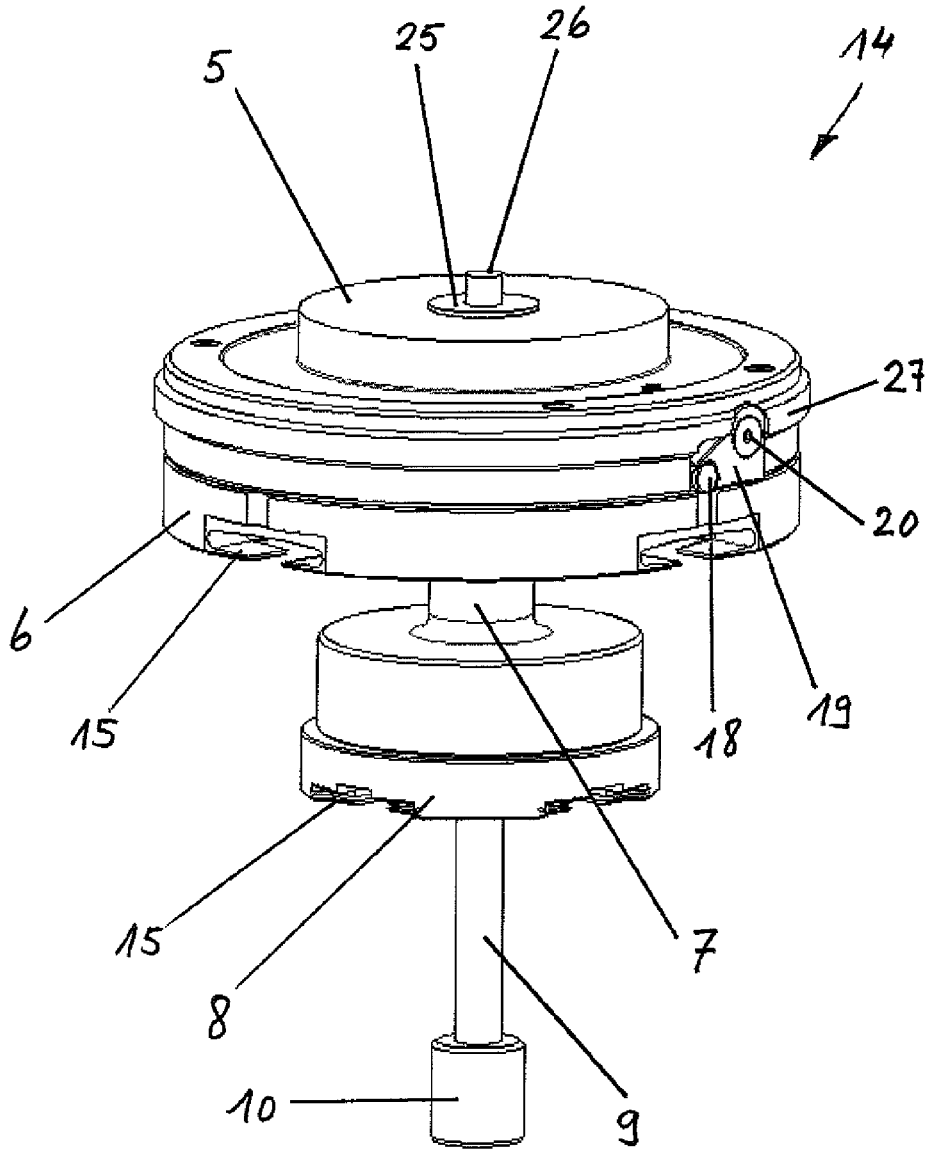
FIG. 4 shows the die press assembly according to the invention alone.

In FIG. 4 the die press assembly 14 is shown on its own, without the die supporting plate 4 and without the gripper 21. The assembly 14 consists at least of the core pin 9, a lower punch holder 8 bolted to the lower punch 7 and the die holder 6 bolted to the die 5. As can be seen, the holders 6,8 are equipped with further elastic tongues 15 for accurate clamping. On the top side of the die 5 the top end surface 25 of the lower punch 7 and the top end surface 26 of the core pin 9 can be seen.

Figures 5A, 5B:
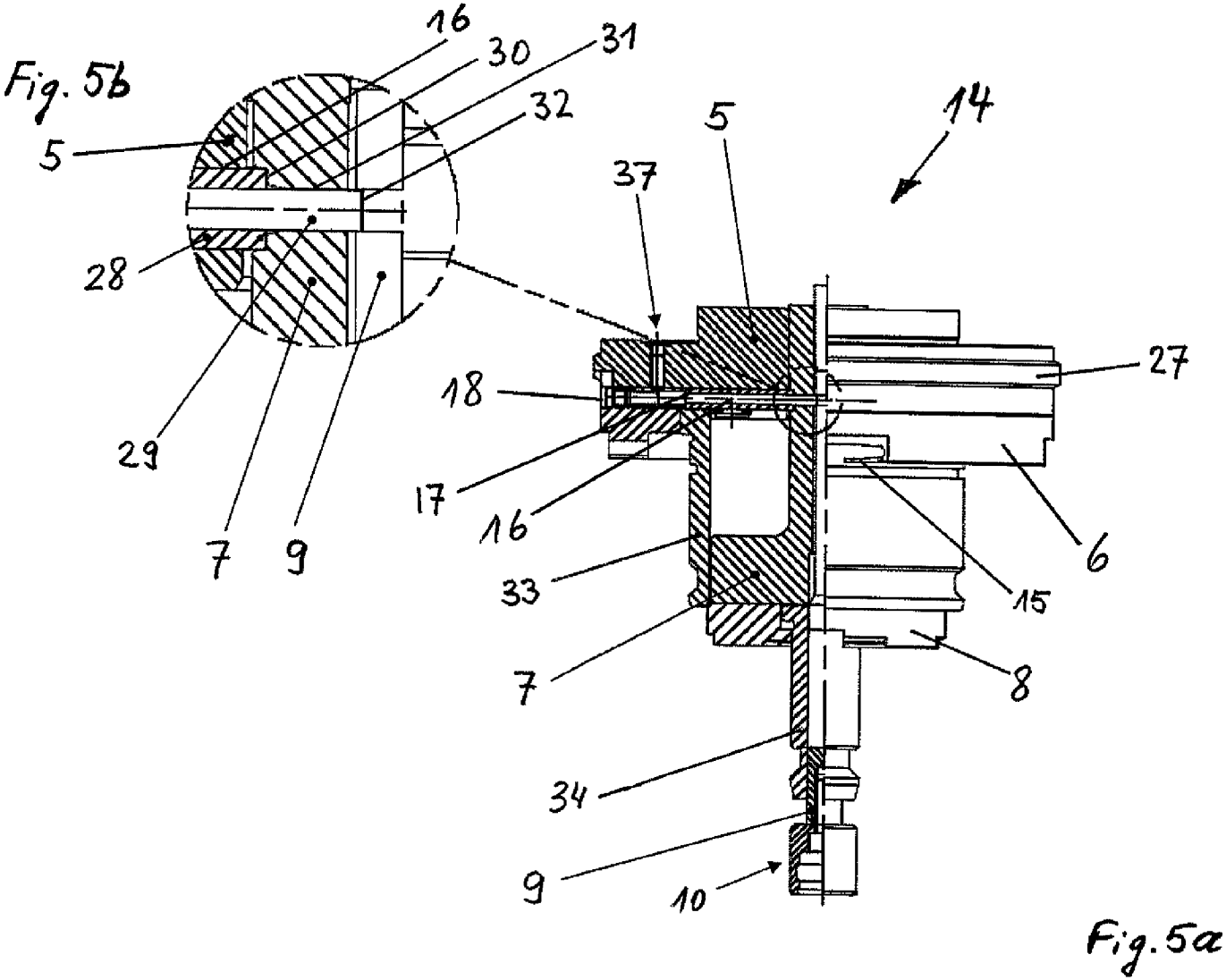
FIG. 5*a* shows a cross section of the die press assembly.
FIG. 5*b* shows an enlargement of a portion of FIG. 5*a* and FIG. 6 shows a partial sectioned top view of the die press assembly.

FIG. 5*a* shows a cross section of the main parts of the die press assembly 14. The die 5 has a flange 27 or a track for the gripper 21. Below the flange 27 the radial bore 16 through the die 5 for taking up the radial locking pin 17 can be seen. As can be seen from FIG. 5*b*, which is an enlargement of the central part of the die 5, the locking pin 17 has two inner end portions 28,29. A first inner end portion 28 of the locking pin 17 that has a larger diameter and locks into a recess 30 in the wall of the lower punch 7 and a second inner end portion 29 of the locking pin 14 that has a smaller diameter and passes through a bore 31 in the lower punch 7 and locks into a further recess 32 in the wall of the core pin 9.

By the radial movement of the locking pin 17 the die 5, the lower punch 7 and the core pin 9 can be held together as a unitary die press assembly 14. The two end portions 28,29 of the locking pin 17 move simultaneously. The locking pin 17 could also be made as one part with two different diameters at the end portions 28,29. The two end portions 28,29 are advantageous for easier adaptation to different dimensions of the lower punch 7 and of the core pin 9. Thereby one gripper 22 can be used for different sizes of the metal cutting inserts. FIG. 5*a* also shows a drawbar 33 connected to the die holder 6, a further drawbar 34 connected to the lower punch holder 8 and the pin end connector 10 as the lower end of the core pin 9.

Figure 6:
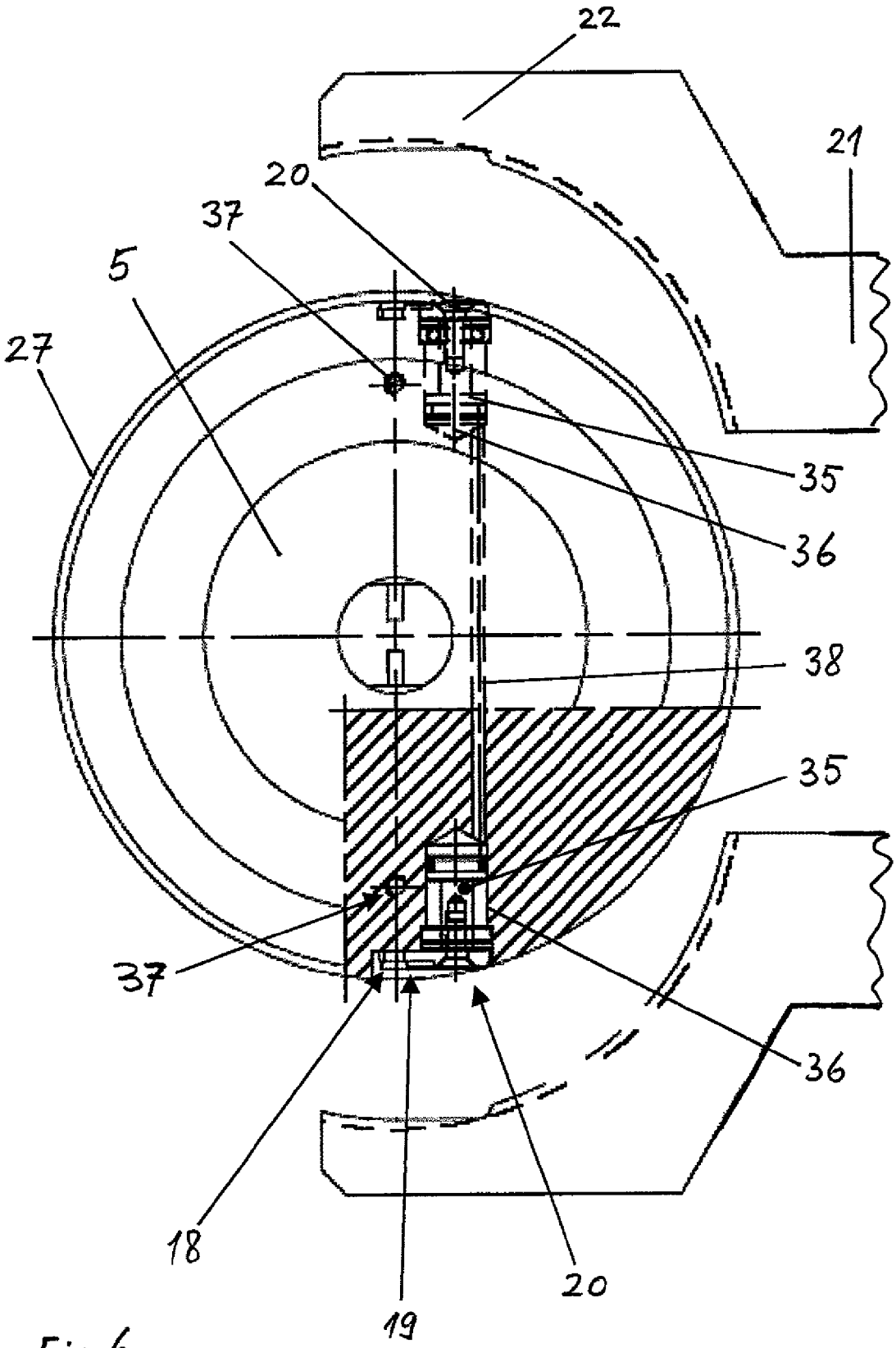

In FIG. 6 a partially sectioned top view of the die press assembly 14 together with the gripper 21 is shown. The outer end portion 18 of the radial locking pin 17 is connected to the screw 20 by means of the plate 19. The screw 20 is screwed into a piston 35 in a cylinder 36. The piston 35 can be moved by pneumatic or hydraulic pressure. To this end an air inlet 37 is foreseen in the top surface of the die 5. In FIG. 6 two pistons 35 in two cylinders 36, connected by a channel 38 are shown at opposite sides of the die 5. When the fingers 22 of the robot gripper 21 close around the flange 27 of the die 5, the piston 35 and the screw 20 as well as the radial locking pin 17 are moved to a locking position.

Loading of a new die press assembly 14 into the work station 1 is very accurate and time saving. First the robot gripper 21 brings the new die press assembly 14 into the work station 1 in a position very close above the chucks 11,12,13 so that the holders 6,8,10 may be clamped. Air or hydraulic pressure is connected to the cylinder 36 for unlocking the die press assembly 14 as the fingers 22 of the gripper 21 are opened. Pressure actuating the piston 35 will move the screw 20, the plate 19 and the locking pin 17 radially outwards to an unlocked position. The holders 6,8,10 will fall a short distance of about 0.1 mm. Directly afterwards the chucks 11,12, 13 are activated for clamping.

The die press assembly 14 described here can be exchanged as one unit by an automatic manipulator. All three main parts, which have to be exchanged if the pressing workstation 1 has to be configured for a new size of cutting insert, can be exchanged in one single operation. The locking movement of the locking pin 17 is coupled directly to the movement of the fingers 12 of the gripper 21. No manual intervention for exchanging, handling or locking is needed. Exchange of one first assembly 14 to the next is done fully automatic, so that the pressing work station 1 can be programmed for unattended pressing of a series of different sizes of cutting inserts.

The invention claimed is:

1. A die press assembly comprising a lower clamp for clamping and holding a lower punch, a die clamp for clamping and holding a die and a core pin clamp for clamping and holding a core pin, wherein the lower punch, the die and the core pin each have a bore or a recess for receiving a locking device, the locking device comprises at least one radial locking pin arranged in a radial bore in the die, the radial locking pin has a first radial inner end portion configured for locking within a recess in the lower punch, and the radial locking pin has a second radial inner end portion configured for locking within a recess in the core pin.

2. A die press assembly according to claim 1, wherein the radial locking device has a radial outer end portion configured for cooperating with a finger of a robot gripper.

3. A die press assembly according to claim 2, wherein the radial locking pin is arranged radially movable by an actuator and a further locking pin is connected to the actuator.

4. A die press assembly according to claim 3, wherein the actuator is a pneumatic piston arranged inside a cylinder in the die.

5. A die press assembly according to claim 3, wherein the actuator is arranged movably by fingers of the robot gripper thereby coupling the movement of the robot gripper automatically to the movement of the radial locking pin into a locking position.

6. A die press assembly according to claim 1, wherein the die press assembly is arranged in a pressing work station for metal powder pressing cutting tools.

* * * * *